US005743662A

United States Patent [19]

Abumehdi et al.

[11] Patent Number: 5,743,662

[45] Date of Patent: Apr. 28, 1998

[54] FRANKING MACHINES AND MEANS FOR DATA ENTRY THERETO

[76] Inventors: Cyrus Abumehdi, 36 Ashworth Place, Harlow, Essex CM17 9PU; Daniel John Lee, 65 Hammonds Lane, Warley, Brentwood, Essex CM13 3AH, both of United Kingdom

[21] Appl. No.: 590,357

[22] Filed: Jan. 25, 1996

[30] Foreign Application Priority Data

Jan. 27, 1995 [GB] United Kingdom ..... 9501602

[51] Int. Cl.[6] ..... B41J 5/30

[52] U.S. Cl. ..... 400/62; 400/74; 235/380; 235/492; 380/51; 364/464.02

[58] Field of Search ..... 400/61, 62, 70, 400/74; 235/375, 380, 382, 492; 380/51; 364/464.02

[56] References Cited

U.S. PATENT DOCUMENTS 4,258,252 3/1981 Simjian .

4,864,618 9/1989 Wright .

FOREIGN PATENT DOCUMENTS 2173238 10/1986 United Kingdom .

2215668 9/1989 United Kingdom .

2215670 9/1989 United Kingdom .

2251212 7/1992 United Kingdom .

*Primary Examiner*—John S. Hilten

*Attorney, Agent, or Firm*—Shoemaker and Mattare, Ltd.

[57] ABSTRACT

A module is disclosed for use with a franking machine for the entry of data into the machine. The module includes a memory and security means operative in response to an interrogation signal from the franking machine to return a signal to the franking machine that the module is authorised for use with the franking machine for the input of data thereto.

4 Claims, 4 Drawing Sheets

FRANKING MACHINES AND MEANS FOR DATA ENTRY THERETO

BACKGROUND OF THE INVENTION

This invention relates to franking machines and in particular to entry of data into franking machines.

Franking machines for printing franking impressions on mail items in respect of postage charges to be applied to those mail items are known. Such franking machines include postage metering means to carry out accounting functions in relation to use of funds in respect of franking of mail items and printing means controlled by the postage metering means to print a franking impression on a mail item, the franking impression including an indication of the postage charge in respect of the item on which the impression is printed.

In order to make the franking machine more user friendly, it is known to store in a look-up table in the postage metering means, or in a weighscale connected to the franking machine, information relating to postage charges in respect of different classes of mail handling and in respect of ranges of weight of mail items for which postage charges apply. Thus a user may place a mail item on the weighscale, select a class of mail handling, for example first or second class internal mail or airmail to another country, and the accounting means of the postage meter is then operated to read the appropriate postage charge from the look up table and to set the postage meter to control the printing means to print that postage charge read from the look-up table. Thus the franking machine is capable of determining the correct postage charge for a mail item of given weight and for a selected class of mail handling without any necessity for the user of the franking machine to be concerned with the amounts of the various postage charges which may apply in respect of the mail item. It will be appreciated that from time to time postage rates may be changed by the postal authority and then it becomes necessary to update the information stored in the memory of the postage metering means to ensure that the 5 postage charges applied to mail items are in accordance with the new postage rates.

It is common for franking machine to be provided with slogan printing means whereby a slogan, chosen by the user of the franking machine, is printed alongside the franking impression on the mail items. In the majority of franking machines currently in use, printing of the franking impression and slogan is effected by means of printing dies carried on a rotatable print drum. One printing die is utilised to print an invariable pattern of the franking impression and a replaceable second print die is utilised to print the chosen slogan. The slogan to be printed could be changed only by replacing the existing slogan printing die with a new slogan printing die. However in later designs of franking machine, the franking impression and the slogan are printed by digital printing means such as ink jet or thermal ink transfer printing devices. Such digital printing devices include a plurality of printing elements disposed in a line such as to print, in a series of printing cycles, dots in selected positions in a line on the mail item, the line in which the dots are printed being displaced in each printing cycle so as to build up a complete printed impression in a line by line manner in the series of printing cycles. The selective operation of the printing elements in each printing cycle is determined by data stored in a memory of the franking machine. Accordingly, the slogan to be printed may be changed by changing data in the memory defining the printed slogan impression.

The postage metering means may be provided with a connector to enable input of signals representing updated information, for example postage rates or a slogan. However it is desirable to prevent input of unverified information and to ensure that only the information from an authorised source is intuit to the postage metering means.

SUMMARY OF THE INVENTION

According to the invention a module for data entry into postage metering means of a franking machine includes a data memory for storing data to be input to the postage metering means and security means operable in response to an interrogation signal from the postage metering means to provide a signal to the postage metering means indicative that said module is an authorised module whereby the postage metering means is enabled to read out data from the memory and to enter said read out data into the postage metering means.

The invention also includes a franking machine in combination with a module as hereinbefore defined.

BRIEF DESCRIPTION OF THE DRAWING

An embodiment of the invention will now be described hereinafter by way of example with reference to the drawing in which.

DESCRIPTION OF THE PREFERRED EMBODIMENT

Figure 1:
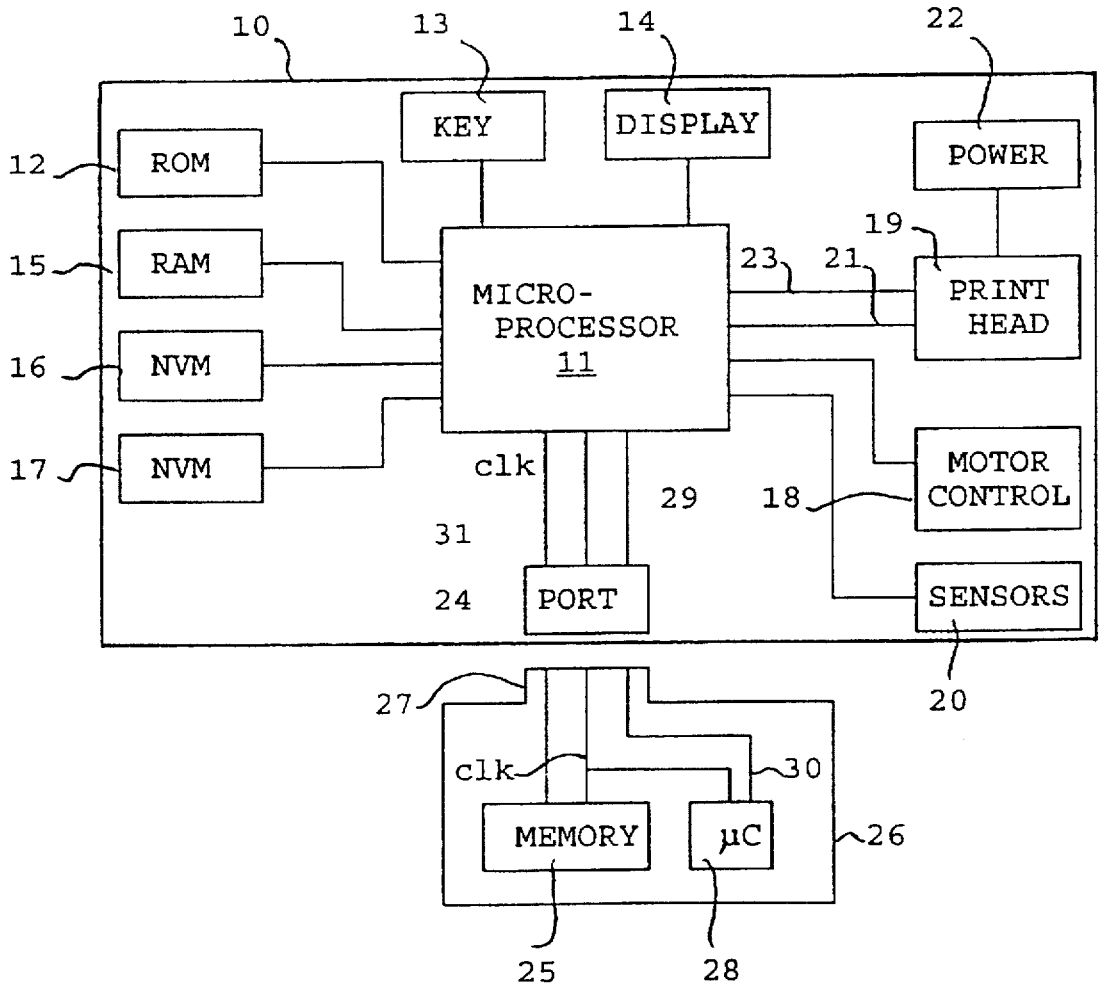
FIG. 1 shows a block diagram of a franking machine and a module connectable to the franking machine for input of information.

Referring to the drawing, a franking machine 10 includes a micro-processor 11 operating under program routines stored in a read only memory (ROM) 12. As is well known in electronic franking machines, a keyboard 13 is provided for input of data by a user and a display 14 is provided to enable display of information to the user. A random access memory (RAM) 15 is provided for use as a working store for storage of temporary data during operation of the franking machine. Non-volatile duplicated memories 16, 17 are provided for the storage of data which is required to be retained even when the franking machine is not powered. Accounting data relating to use of the franking machine for printing franking impressions relating to postage charges for mail items and any other critical data to be retained is stored in the non-volatile memories 16, 17. As is well known in the franking machine art, critical data is duplicated in memories 16, 17 and the data is duplicated within each memory 16, 17. Hence four copies of each data item are stored. Typically, an amount of credit for use in franking mail items is stored in a descending register, an accumulated value used in franking of mail items is stored in an ascending register and a count of the number of mail items franked is stored in an items register. Other values, for example a count of items franked with a postage charge in excess of a predetermined value are stored in further registers. By storing four copies of each data item, in the event of corruption of any copy of an item of data, the data can be restored by reference to the other copies for that item and operation of the franking machine is permitted only when all four copies of each item correspond thereby preventing operation of the franking machine in respect of false accounting and other critical data.

Feeding means (not shown) for mail items is driven by drive motors under the control of a motor controller 18. Operation of the feeding means carries a mail item past a print head 19. The print head preferably is a thermal print head which is operated by the microprocessor 11 as the mail item is carried past the print head by the feeding means to effect transfer of ink from a thermal transfer ink ribbon onto the surface of the mail item so as to print a franking impression and a slogan on the mail item. Sensors 20 are provided to sense and monitor feeding of the mail item and of the ink ribbon. The sensors provide signals to the microprocessor to enable the microprocessor to control operation of the machine. For example a sensor is provided to indicate the speed of feeding of the mail item along the feed bed to enable the microprocessor to control speed of drive of a motor driving an impression roller such that the feed speed is maintained substantially constant. As the mail item is fed past the thermal printing elements of the print head, the microprocessor outputs, on line 21, to the print head in each of a plurality of printing cycles signals selecting those ones of the printing elements which are to be energised in the respective cycle. A pulse of electrical power is supplied to the selected thermal printing elements from a power source 22 when a strobe signal, on line 23, is supplied by the microprocessor.

Postage rate data, data for controlling the print head to print a slogan and other data may be input to the franking machine by means of a port 24. Conveniently the data to be input to the franking machine is stored in a memory 25 of a module 26, the module having a connector 27 for removably connecting the module to the port 24. The memory 25 preferably is implemented by means of an EPROM device.

In order to ensure that the module 26 is an authorised module, the module contains a security device 28 with which, prior to read out of data from the memory 25, the franking machine 10 carries out an interchange of data. Provided the franking machine receives the expected and required response from the security device 28 of the module 26 the franking machine proceeds to read the data from the memory 25 and inputs the data to the franking machine for subsequent storage in non-volatile memory of the franking machine. However if the franking machine does not receive the expected and required response from the module, the microprocessor 10 of the franking machine terminates communication with the module 26 and does not read data from the memory 25 of the module.

Thus, provided an authorised module 26 carrying a security device 28 is connected to the port 24, the franking machine operates to read the data from the memory of the module and to input the data to the franking machine. On the other hand if an un-authorised module 26, which does not carry the security device 28, is connected to the port, the franking machine will recognise that the module is not an authorised module and will not attempt to read data from memory of the module.

An example of a security device 28 for an authorised module 26 comprises a micro-controller programmed to operate, in response to an interrogation signal input to the micro-controller to produce an acknowledgement signal by modifying the interrogation signal input to the micro-controller. Clock signals (Clk) are fed from the microprocessor 11 via the port 24 and connector 27 to the memory 25 and the micro-controller 28 of the module 26. After starting (box 40) a sub-routine (flow chart of FIG. 2) to read data from the module, the franking machine 10 generates (box 41) a digital interrogation signal on line 29 and this signal is transmitted (box 42) via the port 23 and connector 27 to line 30 and thence to the micro-controller 28. In response to the interrogation signal, the micro-controller carries out a predetermined modification (box 43) of the interrogation signal to generate the acknowledgement signal which is returned (box 44) via the line 30, connector 27, port 24 and line 29 to the microprocessor 10. The microprocessor also carries out the same predetermined modification (box 45) of the interrogation signal sent to the module and compares (box 46) the result with the acknowledgment signal received back from the module. If the acknowledgement signal received from the module has the required relationship (YES output of box 47), for example equality, with the result of the predetermined modification carried out by the microprocessor 11 of the franking machine, the microprocessor 11 recognises the module as an authorised module. In response to recognition of the module as an authorised module the microprocessor 11 sends (box 48) a read signal via line 31 connected to a data input/output of the memory 25 of the module 26 and data stored in the memory is read out (box 49) onto the line 31 and thence input to the microprocessor 11 for subsequent writing (box 50) of the data to the non-volatile memories 16 and/or 17 and the routine ends (box 51).

If the module connected to the franking machine does not contain a security device 28, or if the module does contain a security device but the device does not operate to produce the expected and required acknowledgement signal, the required relationship with the result of the modification carried out by the microprocessor 11 will not be obtained (NO output of box 47) the microprocessor 11 terminates (52) the read module sub-routine and does not read data from the module.

Figure 2:
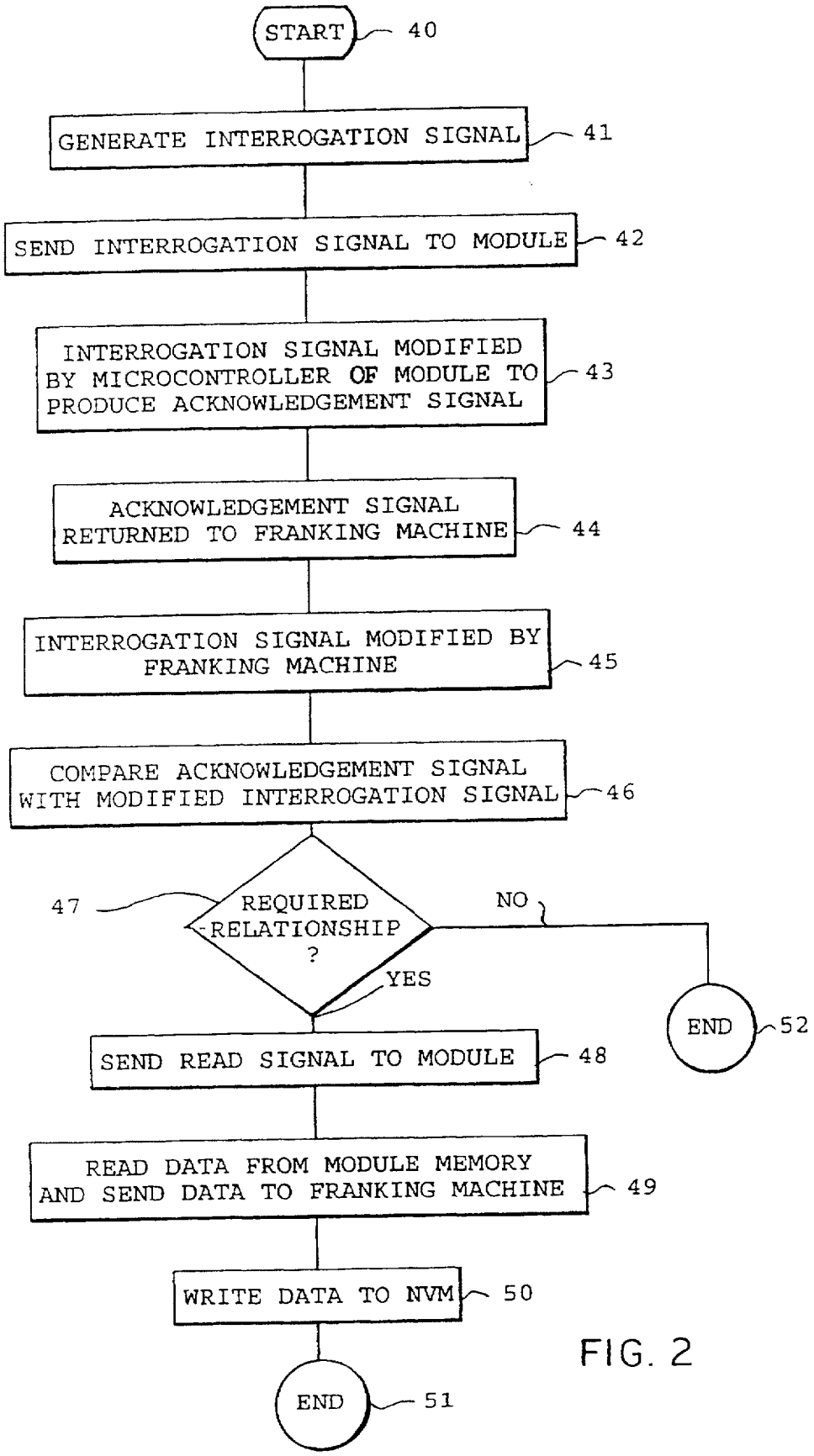
FIG. 2 is a flow chart of a sub-routine for reading data from the module.
Figure 3:
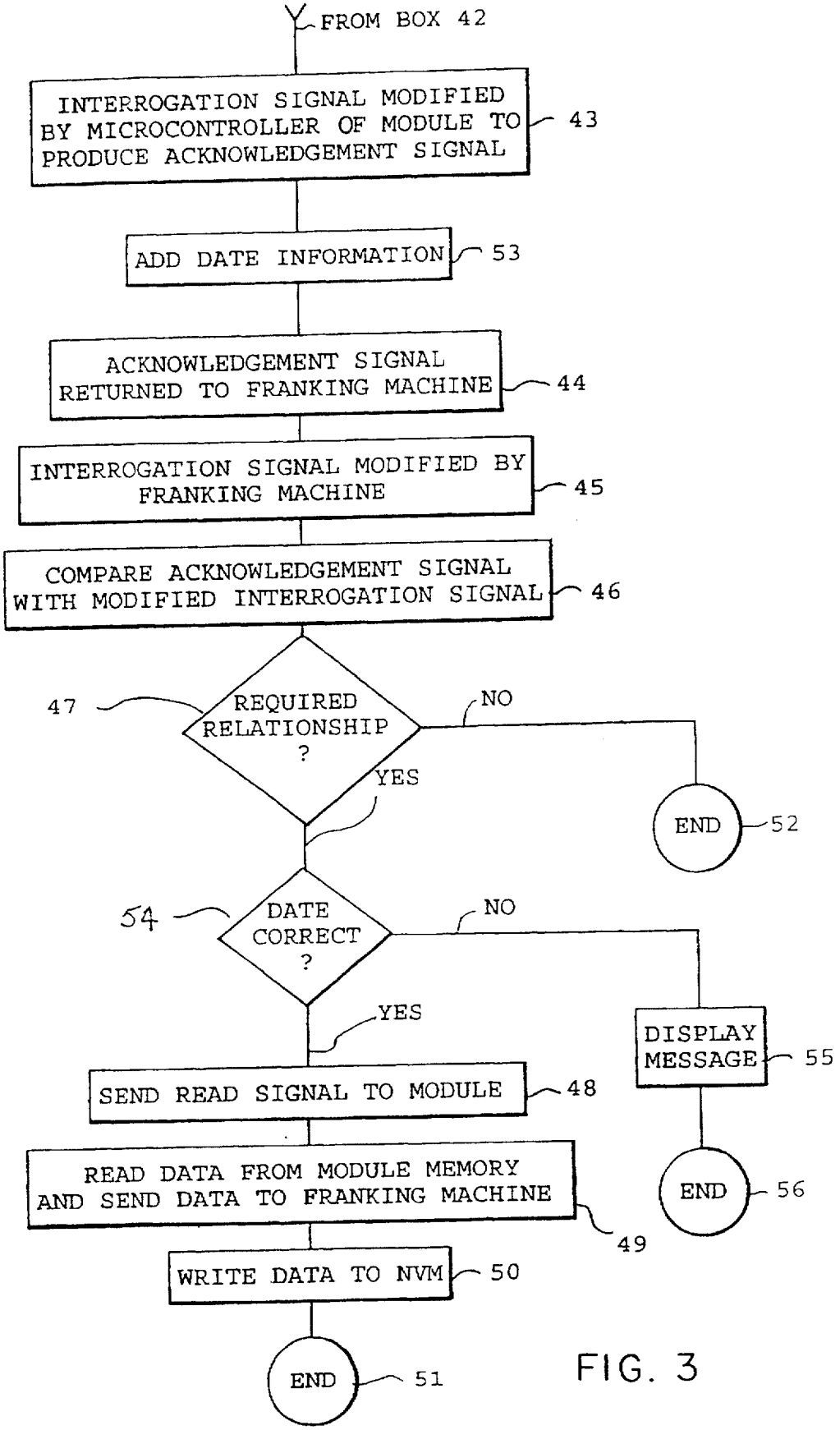
FIG. 3 is a flow chart of a modification of the subroutine of FIG. 2.

The data stored in the memory of the module and intended to be read out into the postage metering apparatus may be data which is effective from a predetermined date. Such data may for example be postage rate data which applies to mail items to be handled by the postal authority on and after a predetermined date. Accordingly if desired, the acknowledgement signal may contain date information and the franking machine be operated to compare the date information from the module with date information stored in the franking machine. The sub-routine illustrated by the flow chart of FIG. 2 is modified to that illustrated by the flow chart of FIG. 3. The micro-controller 28 includes (box 53) date information in the acknowledgement signal. The microprocessor 11 determines (box 54) if the date is correct, i.e. that the date information received from the module corresponds to the date information stored in the franking machine. If the date information corresponds (YES output of box 54), the franking machine is enabled to proceed with read out of the data from the memory (boxes 48, 49). On the other hand if the date information does not correspond (NO output of box 54) the read out is not carried out. If desired the display may be operated to display (box 55) a message to inform the user that the data is not yet effective and to use the module for data input at a later date. The sub-routine then ends (box 56).

Figure 4:
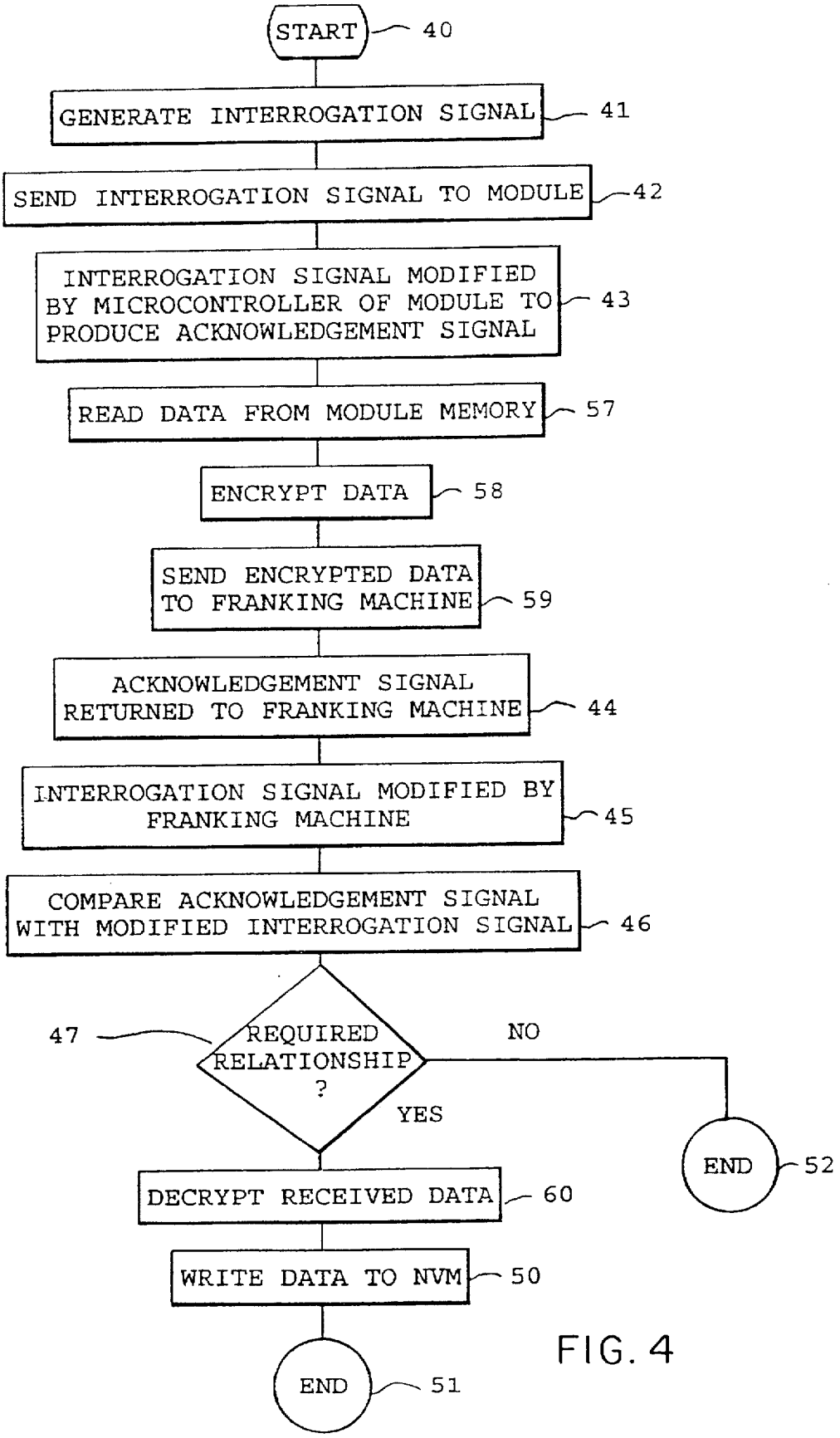
FIG. 4 is a flow chart of a further modification of the sub-routine of FIG. 2.

In a further modified sub-routine illustrated by the flow chart of FIG. 4, instead of or in addition to generating an acknowledgement signal and returning the acknowledgement signal to the microprocessor of the franking machine, the security device may be utilised to encrypt data read from the memory 25 and to transmit the encrypted data to the franking machine. Accordingly the micro-controller reads (box 57) the data from memory 25 and encrypts (box 58) the data and then sends (box 59) the encrypted data to the microprocessor 11. The microprocessor 11 operates to decrypt (60) the received encrypted data. Accordingly, if an authorised module is connected to the franking machine the data read from the memory is encrypted in the module and decrypted in the franking machine to produce correct data for storage in memory of the franking machine. However if an unauthorised module is connected to the franking machine, the data read from the memory thereof is not encrypted and hence, when the microprocessor attempts to decrypt the non-encrypted data, the data will be garbled and useless.

It is to be understood that it is not intended that the module 26 be utilised for the input of secure data to the franking machine and hence the purpose of the security device in authorised modules is not for the purpose of providing security for the data per se but rather to ensure that only authorised modules are used for the input of data. However if desired the module may be used for input of secure data, the data being encrypted prior to writing to the memory 25 so that the memory stores encrypted data.

The security device is constructed and arranged to operate such that it cannot easily be copied. However since the purpose of the security device is not for security of the data, the security device does not need to provide a high degree of security, it being sufficient if the security device makes it uneconomic for others parties to attempt to supply modules which emulate authorised modules.

It will be appreciated that the data stored in the EPROM memory 25 cannot be overwritten and hence it is not possible for the data in an authorised module to be changed and the authorised module to be reused in an authorised manner. However, if the data occupies only a part of the memory it could be possible for unauthorised data to be written to the previously unused part of the memory. Accordingly when loading the memory 25 with authorised data it is preferred to ensure that substantially the whole of the memory 25 is utilised and storage locations which otherwise would not be utilised to store data are filled with superfluous or redundant data.

When the memory of the module is utilised to store slogans to be printed, the memory may store a variety of slogans and the user of the franking machine may select one or more of the slogans to be read out and input to the franking machine. The data relating to a slogan includes print data for controlling operation of the print head to print that slogan and preferably includes a description of the slogan for display on the display device 13. Accordingly when a user selects data for a slogan, the franking machine reads out the description and displays the description to enable the user to verify that the data for the required slogan has been selected. The user may then confirm the selection and the print data is read out and stored in memory of the franking machine for subsequent use in printing slogans. Alternatively the selection may be rejected by the user in which event read out of data for that slogan is terminated.

The description may be displayed as alpha-numeric characters sufficient to enable recognition of the slogan or, when the display 14 is capable of displaying pictorial data, in pictorial form representing the slogan as it will be printed.

The memory space in the memory of the module may be partitioned such that blocks of sufficient size for the data relating to each slogan are provided. The first storage locations of each block contain the slogan description data and the remainder of each block contains the print data for the respective slogan. A header at the start of the memory locations contains pointers to the start locations of each of the blocks.

We claim

1. A franking machine including electronic circuits operable to effect postage metering functions and operable to effect a data input routine;

a data input module including a memory and security means and releasably connected to said electronic circuits;

in the data input routine said electronic circuits sending an interrogation signal to said security means of said data input module; said security means being operative in response to receipt of said interrogation signal to generate a first signal comprising a predetermined modification of said interrogation signal and to send said first signal to said electronic circuits;

said electronic circuits generating a second signal comprising a predetermined modification of said interrogation signal and to effect comparison of said first signal received from said security means and said second signal; and only in response to said comparison of said first signal and said second signal indicating a predetermined relationship between said first signal and said second signal to read data from said memory of said data input module.

2. A franking machine as claimed in claim 1 including date means registering first date information and wherein said memory of said data input module stores second date information; wherein in the data input routine the security means is operative in response to the interrogation signal to send said second date information to the electronic circuits and the electronic circuits are operative only in response to the first date information having a predetermined relationship with said second date information to read the data from the memory of the data input module.

3. A franking machine as claimed in claim 2 wherein the electronic circuits are operative only in response to the first date information being earlier than the second date information.

4. A franking machine including electronic circuits operable to effect postage metering functions and operable to effect a data input routine;

a data input module including a memory and security means and releasable connected to said electronic circuits; in said data input routine said electronic circuits sending an interrogation signal to said security means of said data input module; said security means being operative in response to receipt of said interrogation signal to generate ;a first signal comprising a predetermined modification of said interrogation signal, to read out data from said memory and to encrypt said data read from said memory and to send said first signal and the encrypted data to said electronic circuits;

said electronic circuits generating a second signal comprising a predetermined modification of said interrogation signal and to effect comparison of said first signal received from said security means and said second signal; and only in response to said comparison of said first signal and said second signal indicating a predetermined relationship between said first signal and said second signal to decrypt the encrypted data received from the security means of the data input module.

* * * * *